US006672230B2

(12) United States Patent
Green et al.

(10) Patent No.: US 6,672,230 B2
(45) Date of Patent: Jan. 6, 2004

(54) MODULAR BLOCK ASSEMBLY FOR TUFTING MACHINE

(75) Inventors: Jerry Green, Signal Mountain, TN (US); Gary Ingram, Ooltewah, TN (US)

(73) Assignee: Tuftco Corporation, Chattanooga, TN (US)

( * ) Notice: Subject to any disclaimer, the term of this patent is extended or adjusted under 35 U.S.C. 154(b) by 0 days.

(21) Appl. No.: 10/075,649

(22) Filed: Feb. 13, 2002

(65) Prior Publication Data

US 2003/0131772 A1 Jul. 17, 2003

Related U.S. Application Data

(63) Continuation-in-part of application No. 10/038,219, filed on Jan. 3, 2002.

(51) Int. Cl.[7] ..... D05C 15/08
(52) U.S. Cl. ..... 112/80.6
(58) Field of Search ..... 112/80.6, 80.5, 112/80.4, 80.45, 80.55, 80.7, 80.52

(56) References Cited

U.S. PATENT DOCUMENTS

| | | | | | |
|---|---|---|---|---|---|
| 4,170,949 | A | | 10/1979 | Lund | 112/79 |
| 4,313,388 | A | * | 2/1982 | Biggs et al. | 112/80.53 |
| 4,491,078 | A | | 1/1985 | Ingram | 112/79 |
| 4,608,934 | A | | 9/1986 | Card | 112/80.6 |
| 4,669,171 | A | | 6/1987 | Card | 29/446 |
| 4,691,646 | A | | 9/1987 | Card | 112/80.6 |
| 4,693,191 | A | | 9/1987 | Card | 112/80.6 |
| 4,817,541 | A | * | 4/1989 | Magourik | 112/80.6 |
| 5,295,450 | A | | 3/1994 | Neely | 112/80.45 |
| 5,896,821 | A | | 4/1999 | Neely | 112/80.52 |
| 5,954,003 | A | * | 9/1999 | Beyer et al. | 112/80.45 |
| 6,116,173 | A | * | 9/2000 | Beyer | 112/80.45 |
| RE37,108 | E | | 3/2001 | Neely | 112/80.45 |

OTHER PUBLICATIONS

Cobble Division–Spencer Wright Indus.,Replaceable Components Module (RCM), circa 1985, pp. 1–2.

* cited by examiner

*Primary Examiner*—Ismael Izaguirre
(74) *Attorney, Agent, or Firm*—Douglas T. Johnson

(57) ABSTRACT

Lateral pins are used to provide a tufting machine modular gauge assembly that allows damaged or broken gauge elements to be replaced individually. The modular gauge assembly consists of a gauge bar with a plurality of modular blocks removably attached to the bar. The modular blocks are six sided with a detent and fastener mechanism for attaching the block to the gauge bar. The gauge elements may be attached to the block by dedicated screw-pins or by a lateral pin that passes through all the gauge elements within a block. The lateral pin may either pierce the gauge elements or abut the gauge elements. Abutting pins may be malleable and segmented and secured in position by conical ended bolts.

25 Claims, 8 Drawing Sheets

5
10
22a
25
30
35
20
15

5
40
40
25
35
100
32
10
31
30
75
22b
55
50
51
65
85
70
45
22a
15
60
20

165
45
110
90
120
15
115
60

MODULAR BLOCK ASSEMBLY FOR TUFTING MACHINE

This application is a continuation-in-part of U.S. patent application Ser. No. 10/038,219, filed Jan. 3, 2002 which is incorporated in its entirety.

FIELD OF THE INVENTION

The present invention relates to a tufting machine with replaceable self-aligning gauge modules and is more particularly concerned with gauge modules with individually replaceable gauge elements which can be readily installed and removed.

BACKGROUND OF THE INVENTION

Tufting machines are built with precision so that the needles and loopers of the machine are accurately spaced from each other along the needle bar or looper bars. The loopers and needles must be spaced from each other so that the looper bills pass closely adjacent to the needles to engage and hold loops of yarns carried by the needles. When assembling a tufting apparatus, errors in positioning these gauge elements may accumulate as the work progresses. The present invention seeks to establish consistency with these parts across the width of the apparatus, to provide a tufting environment, suitable even for narrow gauge configurations. The present invention also addresses the problem of replacing individual gauge elements that become broken or damaged during tufting. In most modular designs, a broken gauge element requires discarding the entire modular block containing a set of about one to two dozen gauge elements. The present invention allows for quick and efficient replacement of individually damaged gauge elements.

The idea of replacing individual components of assemblies in tufting machines is not new. In the past, knife holder assemblies have been devised that allow for the replacement of individual knives. The knives were arranged in preassembled or modular fashion in a knife holder, each knife holder having a guide mechanism which enabled groups of knives, each group in a separate holder, to be positioned on a carrying member of a tufting machine and maintained in appropriate alignment. U.S. Pat. Nos. 4,608,934; 4,669,171; 4,691,646; and 4,693,191 illustrate such prior art knife holder assemblies in which parallel knives are disposed. These prior art knife holder assemblies are then disposed in transverse bars provided with guides for positioning the holders in appropriate positions on a tufting machine.

Needles have previously been individually secured in modular gauge blocks as shown in U.S. Pat. No. 4,170,949, and hooks and knives have also been individually secured in gauge parts mounting blocks as shown in U.S. Pat. No. 4,491,078. These designs have used individual clamping screws to hold each gauge element in place. These blocks were not mated with slots on the carrying members and were heavily machined. In addition, the clamping screws used in these gauge blocks have typically been flat ended and have relied upon the flat tip pushing directly against the gauge element to securely position those gauge elements. When the blocks are machined from relatively soft metals such as aluminum, there has been a tendency for the threads of the block to become worn and allow too much play for all of the screws to securely hold their corresponding gauge elements.

More recently attempts have been made to incorporate needles and loopers into replaceable modular blocks. U.S. Pat. Nos. RE37,108, 5,896,821, 5,295,450 illustrate such modular gauge assemblies in which the gauge elements are permanently embedded into the modular block. The block is attached to the guide bar with a single screw allowing for removal and replacement of the block. One shortcoming of these modular blocks is that when a single gauge element breaks the entire modular block must be discarded.

SUMMARY OF THE INVENTION

The present invention includes a modular gauge assembly that attaches to a gauge bar. The gauge bar has a plurality of positioning recesses that allows a detent on an individual modular block to be accurately positioned along the gauge bar. Each modular block typically includes a front surface, a pair of side surfaces opposed to each other, a rear surface opposite to the front surface, and a bottom surface.

A tongue, which may or may not be a part of the cast block extends from a rear or bottom surface of the modular block. The tongue includes a threaded hole which along with a securing screw serves to mount the block to a gauge bar. The threaded hole aligns with the gauge bar receiving hole when the tongue of the modular block is positioned properly with a recess on the gauge bar. When sufficiently tightened, the securing screw holds the modular block to the gauge bar.

At least the front surface of the block contains a plurality of spaced parallel slots so that gauge elements may be positioned in the slots with proper spacing. The proximal ends of the gauge elements may have apertures or channels recessed therein. In one embodiment of the present invention the proximal ends of the gauge elements are inserted into the block and secured there by a lateral pin that enters the block on one of the opposing side surfaces and passes through apertures on the proximal ends of the gauge elements. An alternative embodiment biases a lateral pin resting in a channel on the proximal ends of the gauge elements by tightening a securing bolt that is in communication with the lateral pin through an opening on the block. The preferred securing bolts have conical ends to exert a wedging or camming force against the lateral pin. In either case the gauge elements are secured by a lateral pin engaging the gauge elements. Individual gauge elements can be replaced by demounting the affected block, removing the lateral pin and removing a selected gauge element. After the selected gauge element is removed a new gauge element may be re-inserted into the proper vertical slot and secured by the lateral pin and securing bolt.

A plurality of modular blocks are arranged along the surface of the gauge bar and are vertically positioned on the gauge bar by a horizontal surface of the gauge bar or of a guide bar that passes through a guide bar channel on the gauge bar. The width of each block is substantially equal to the distance between the positioning recesses of the gauge bar so that the edges of the blocks abut one another and the blocks are laterally positioned.

In an alternative embodiment of the present invention each modular gauge assembly attaches to a gauge bar having a plurality of positioning recesses that allows the detent on the individual modular block to laterally position the block on the gauge bar. Each modular block typically includes a front surface, a pair of side surfaces opposed to each other, a rear surface opposite to the front surface, and opposing bottom and top surfaces. The rear surface contains a rectangular tab or detent that includes a threaded hole to receive a securing screw. The threaded hole aligns with the gauge bar receiving hole when the modular block is positioned properly on the gauge bar. When tightened, the securing screw holds the modular block securely to the gauge bar. A plurality of gauge holes extend from the bottom toward the top surface, in some cases passing through the modular block. Gauge elements with proximal ends adopted to be received within the gauge holes may be positioned with proper spacing in the block. Gauge elements that have the proximal end inserted into the block are securely positioned by pin-screws that enter the block below the tab on the rear surface. The pin-screws are positioned beneath the tab. In this fashion, the pin-screws can be accessed without removing the modular block from the gauge bar. When engaging rounded gauge elements such as tufting needles, the pin screws may advantageously have conical ends to hold the gauge elements by wedging or camming force.

Accordingly, it is an object of the present invention to provide a tufting machine where the gauge elements of the tufting machine are accurately positioned within a modular block assembly.

Another object of the present invention is to provide in a tufting machine, a system which can facilitate the rapid change over of one or more damaged gauge elements, reducing to a minimum the downtime of the tufting machine.

Another object of the present invention is to provide in a modular block assembly, a system which can facilitate the rapid change over of individual damaged gauge elements, reducing the cost of repairing broken gauge elements and removing the need to replace entire modular blocks when a single gauge element becomes damaged.

Other objects, features, and advantages of the present invention will become apparent from the following description when considered in conjunction with the accompanying drawing wherein like characters of reference designate corresponding parts throughout several views.

DETAILED DESCRIPTION

The present invention is designed for use in tufting machines of the type generally including a needle bar carrying one or more rows of longitudinally spaced needles that are supported and reciprocally driven by a plurality of push rods. In the tufting zone, the needles carry yarns which are driven through a backing fabric by the reciprocation of the needles. While penetrating the backing fabric, a plurality of longitudinally spaced hooks cooperate with the needles to seize loops of yarns and thereby form the face of a resulting fabric. In some cases the hooks will cooperate with knives to cut the loops of yarn seized on the hooks and thereby form a cut pile face for the fabric. The present invention is directed to modular units for holding loopers or hooks and for holding needles to facilitate their cooperation during the tufting process.

Figures 1, 2, 3:
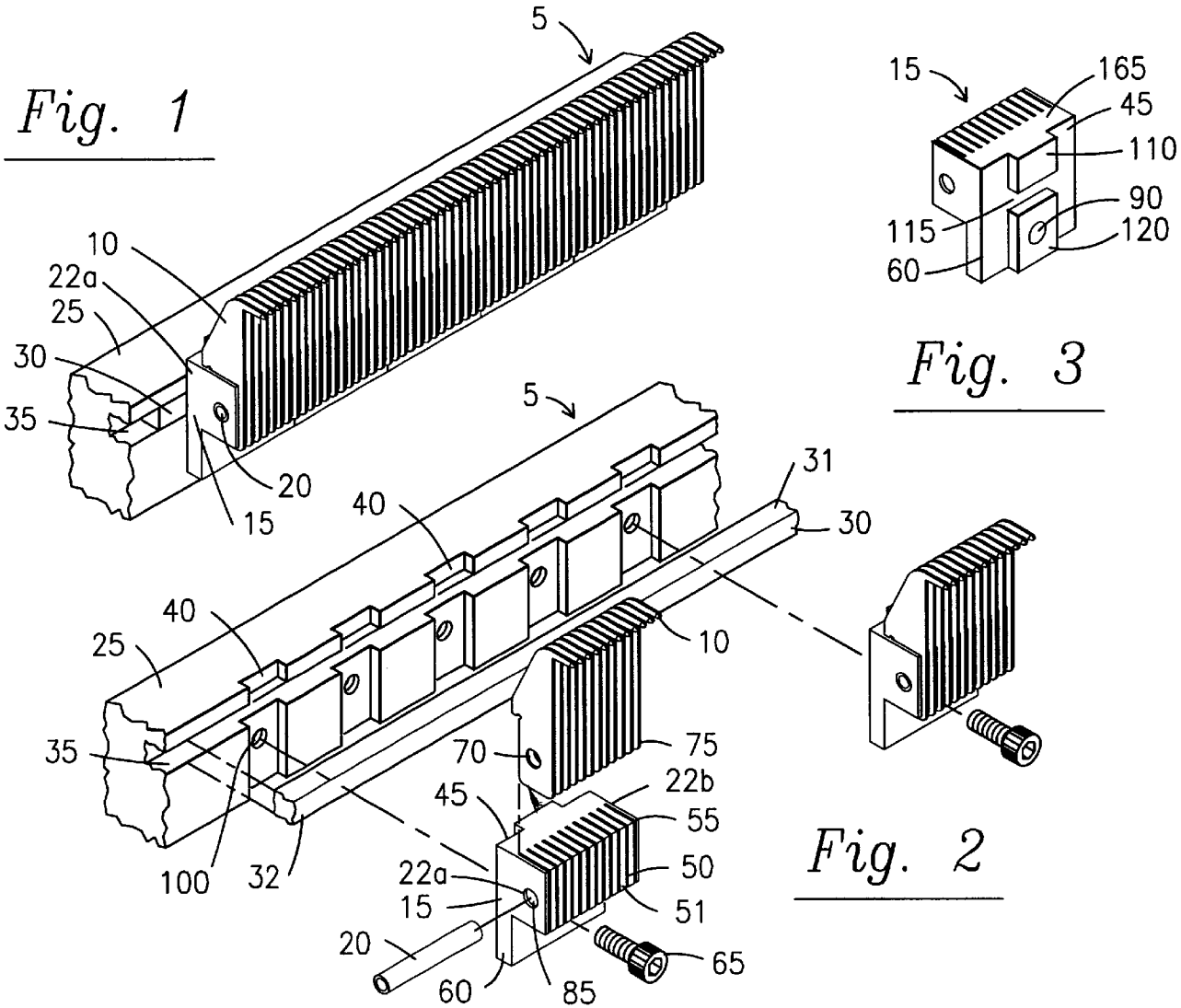
FIG. 1 is a fragmentary perspective view of a modular block assembly with single looper modular blocks in place on a gauge bar.
FIG. 2 is an exploded perspective view of the modular block assembly of FIG. 1 with modular blocks removed from the gauge bar, and one looper modular block disassembled.
FIG. 3 is a perspective view of the rear surface of a modular block of FIG. 1.

Referring in detail to FIG. 1, a modular block assembly 5 is illustrated having a single row of gauge elements 10, in this case loopers, housed in a series of modular blocks 15. The individual gauge elements 10 are fastened to each block 15 by a lateral pin 20. As better illustrated in FIG. 2, the lateral pin 20 enters the modular block 15 at one of the opposing side surfaces 22*a*, 22*b*. The gauge bar 25 and guide bar 30 are used in concert to position the modular blocks 15 relative to one another. The guide bar 30 extends laterally through channel 35 substantially the entire length of the gauge bar 25. The tab breaks 115 of the modular blocks 15 engage with guide bar 30 as shown in FIG. 3, to vertically align the individual blocks 15 in the modular block assembly 5.

FIG. 2 illustrates a portion of the modular block assembly 5 with the blocks 15 detached from the gauge bar 25. The gauge bar 25 has a plurality of vertical recesses 40. The recesses 40 are crossed by lateral channel 35 so that guide bar 30 fits between the gauge bar 25 and the rear surfaces 45 of the modular blocks 15. Guide bar 30 creates upper face 31 and lower face 32 which are normal to the side walls of recesses 40. When tab breaks 115 of modular blocks 15 engage these faces 31, 32, the faces serve as restraining surfaces to hold blocks 15 in vertical alignment.

One modular block 15 in FIG. 2 is disassembled and removed from the gauge bar 25 to reveal spaced parallel slots 50 divided by vertical walls 51 located on the front surface 55 of the block for receiving the proximal ends 75 of the gauge elements 10. The illustrated proximal ends 75 of the gauge elements 10 contain apertures such as pinholes 70. When the gauge elements 10 are positioned in the modular block 15 the pinholes 70 align with apertures formed in side surfaces of the block such as pin opening 85. Lateral pin 20 is then inserted through pin opening 85 in one of the opposing side surfaces 22*a*, 22*b*, and the pinholes 70 for each gauge element 10 to fasten the gauge elements 10 in block 15.

In illustrated modular blocks 15 containing only a single row of gauge elements 10, a tongue portion 60 extends from the rear surface 45 of the modular block 15. The tongue 60 has an opening, preferably in the form of hole 90, as shown in FIG. 3. When the modular block 15 is positioned on the gauge bar 25, threaded hole 90 aligns with another hole 100 located in a gauge bar recess 40. Once a modular block 15 is positioned a securing screw 65 can be inserted through hole 90 and tightened into the hole 100 on the gauge bar 25. A modular block 15, once fixed in place by the securing screw 65, is prevented from lateral and vertical movement. The screw 65 and side walls of vertical recesses 40 resist against horizontal movement while the screw 65 and faces 31, 32 of the guide bar 30 resist against vertical movement. The fixed position of the blocks 15 insures that the gauge elements 10 remain properly aligned during the tufting process.

FIG. 3 shows the rear surface 45 of a modular block 15 having a single row of gauge elements 10. On the rear surface 45 is a detent in the form of an elongated tab 110 extending vertically from the top 165 of the block to the bottom of the tongue portion 60 of the block. Tab 110 has a horizontal break 115 that engages with guide bar 30 to vertically position block 15 on the gauge bar 25. The walls of break 115 are preferably substantially planar and parallel so that a part of the rectangular cross section of guide bar 30 closely fits within break 115. The lower segment 120 of the tab contains the opening 90 where the securing screw 65 enters and attaches to a receiving hole 100 in the gauge bar 25.

Figures 4, 5:
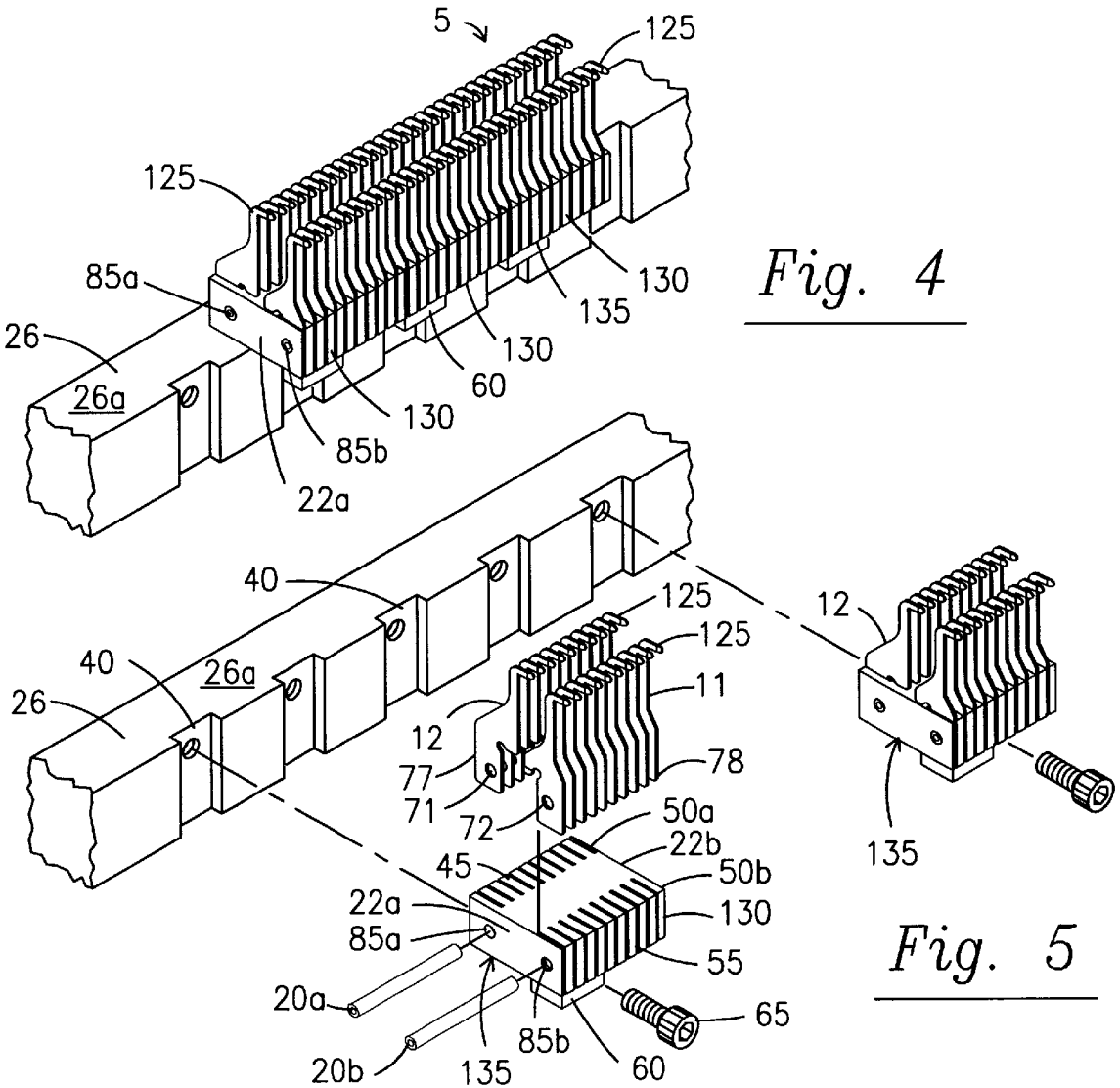
FIG. 4 is a fragmentary perspective view of a double looper modular block assembly with modular blocks in place on the gauge bar.
FIG. 5 is an exploded perspective view of the modular block assembly of FIG. 4, with modular blocks removed from the gauge bar and one block disassembled.

FIG. 4 illustrates a section of a modular block assembly 5 with three double gauge element modular blocks 130 mounted on the gauge bar 26. Each modular block 130 contains two transverse gauge element rows 125, the forward gauge elements 12 forming a first row 125 and rear gauge elements 11 forming a second row. Modular blocks 130 have two apertures such as pin openings 85*a*, 85*b* that are spaced apart on the side surfaces 22*a*, 22*b* of the block 130. Unlike blocks 15 in FIG. 1, a portion of the double gauge modular blocks 130 rests on top of the gauge bar 26 to vertically position blocks 130. This is accomplished by using a downwardly extending detent such as tongue 60 illustrated near the center of the bottom 135 of blocks 130.

FIG. 5 shows an exploded view of modular block 130 containing two rows 125 of gauge elements 11, 12. The gauge bar 26 in FIG. 5 has a plurality of vertical recesses 40. Vertical recesses 40 receive tongues 60 to horizontally position blocks 130 along the gauge bar 25. Vertical positioning is accomplished by resting part of the bottom surface 135 of gauge blocks 130 on the top surface of gauge bar 25. Modular block 130 in FIG. 5 is disassembled and removed from the gauge bar 26 to reveal the spaced parallel slots 50*a*, 50*b* located on the front 55 and rear surface 45 of the block 130 for receiving the proximal ends 77, 78 of the front and rear gauge elements 12, 11.

The proximal ends 77, 78 of the gauge elements 12, 11 contain openings such as pin holes 71, 72 which when positioned in slots 50*a*, 50*b* of modular block 130 align with pin openings 85*a* or 85*b*, respectively. The lateral pins 20*a*, 20*b* are inserted through the pin openings 85*a* or 85*b* on one of the opposing side surfaces 22*a*, 22*b* and through pin holes 71, 72 in the proximal ends of each gauge element 11, 12 to fasten the gauge elements 11, 12 in the modular block 130.

In the illustrated modular blocks 130 the tongue portion 60 of the modular block 130 extends centrally from the bottom surface 135. Tongue 60 defines an opening (not shown). When modular blocks 130 are positioned on gauge bar 26, this opening aligns with a threaded receiving hole 100, located in vertical recesses 40 of gauge bar 26. Once the modular block 130 is positioned a securing screw 65 can be inserted through the opening in tongue 60 and tightened into threaded receiving hole 100. Modular blocks 130, once fixed in place by securing screws 65, are prevented from lateral movement by the securing screw 65 and interface of the detent against walls of vertical recesses. Similarly, modular blocks 130 are prevented from vertical movement by securing screw 65 and interface of bottom surface 135 against the top surface 26*a* of gauge bar 26. The fixed position of the block 130 insures that the gauge elements 11, 12 remain properly aligned during the tufting process.

Figure 6:
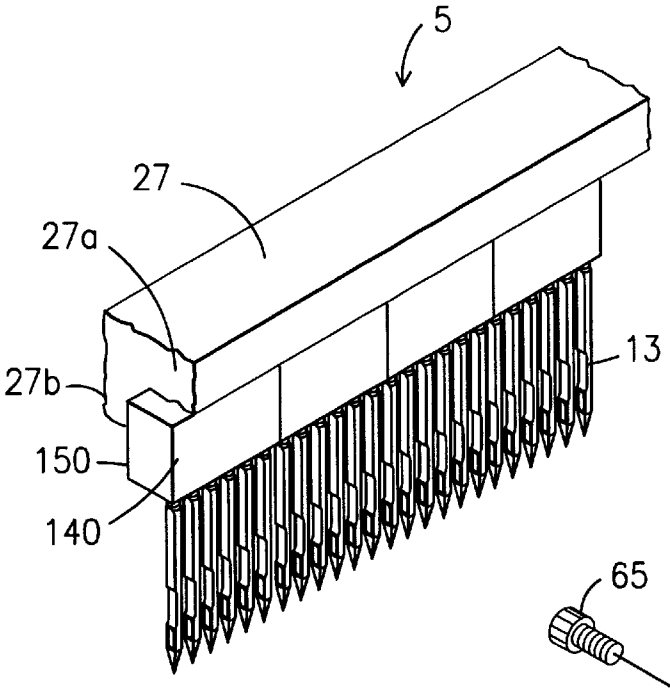
FIG. 6 is a fragmentary perspective view of a modular needle block assembly with modular blocks in place on a gauge bar.

Referring now to FIG. 6, another aspect of the present invention depicts a section of a modular block assembly 5 having a row of gauge elements, in this case needles 13, housed in clamping modular blocks 140. FIG. 6 shows four clamping modular blocks 140 attached to gauge bar 27. The clamping modular blocks 140 are positioned such that the lower portion 150 of the block 140 extends beneath the gauge bar 27. This exposed lower portion 150 contains individual clamping elements, such as screw-pins 145, shown in FIG. 7, that hold the gauge elements 13 in place in the block 140. The gauge bar 27 has a horizontal shelf portion 27*a* and a vertical portion 27*b* which join to form an interior right angle into which the blocks 140 are positioned.

Figure 7:
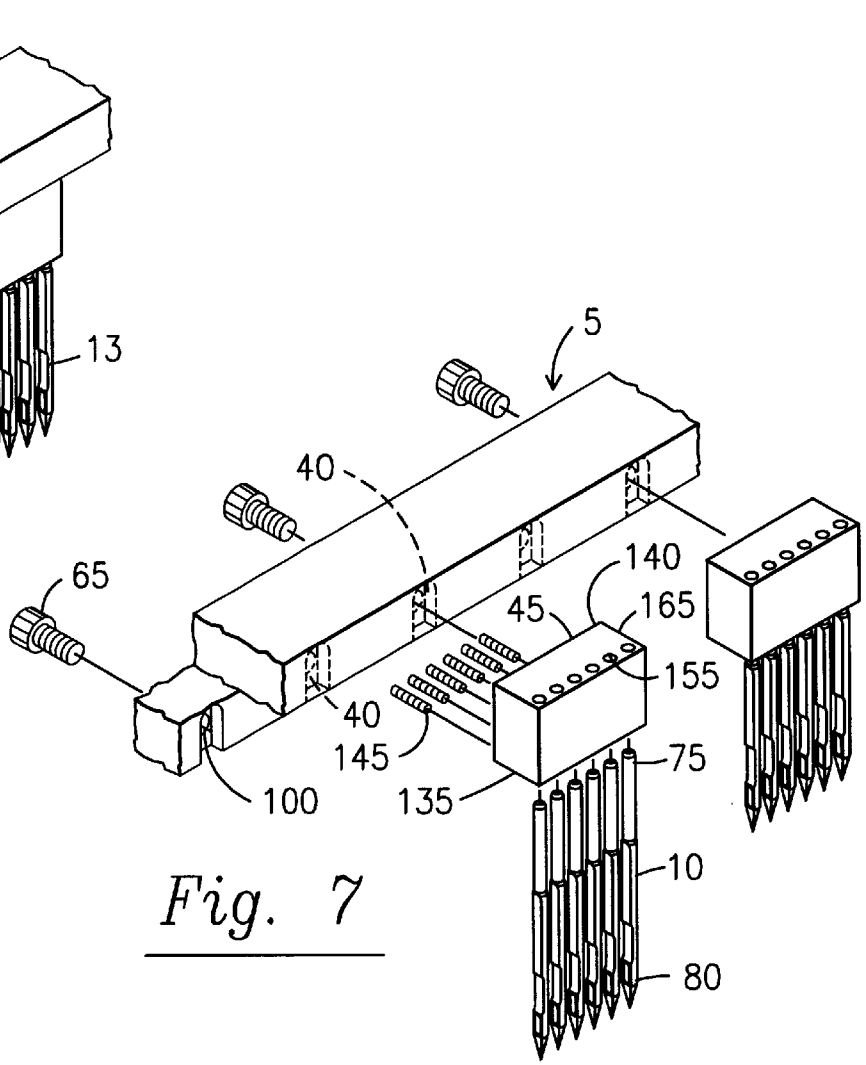
FIG. 7 is an exploded fragmentary perspective view of the modular needle block assembly of FIG. 6 with the modular blocks removed from the gauge bar and one block disassembled.

FIG. 7 illustrates a portion of a modular block assembly 5 with screw-pin modular blocks 140 detached from the gauge bar 27 and one block 140 disassembled. The gauge bar 27 has a plurality of vertical recesses 40 on the inner surface of vertical portion 27*b* of the gauge bar 27. As illustrated, the recesses 40 do not extend the entire height of the wall portion 27*b* of the gauge bar 27. Each recess 40 preferably contains a clearance hole 100 which receives a securing screw 65 to attach blocks 140 to the gauge bar 27. The rear surfaces 45 of modular blocks 140 have a detent such as tab 160 with an opening, such as threaded hole 90 (shown in FIG. 8), positioned to align with holes 100, located in the vertical recesses 40 of gauge bar 27. Once a modular block 140 is positioned in the interior right angle between the shelf portion 27*a* and wall portion 27*b*, with tab 160 received in a vertical recess 40, the securing screw 65 can be inserted through the corresponding hole 100 in the wall portion 27*b* into the threaded hole 90 in the tab 160 and tightened to hold the modular block 140 in place. Once fixed in place by securing screw 65, the modular block 140 is prevented from lateral movement by the action of the tab 160 fitting between the vertical walls of the vertical recess 40, by the screw 65. Vertical movement is restrained by action of the screw 65 and the interface of the top surface 165 of block 140 with the bottom of shelf portion 27*a* of the gauge bar 27. The fixed position of the block 140 insures that the gauge elements 10 remain properly aligned during the tufting process.

FIG. 7 also depicts a disassembled clamping modular block 140 thereby revealing the spaced parallel gauge element openings 155 which extend from the top surface 165 to the bottom surface 135 of the block 140. Openings 155 need not extend completely to the top surface 165 for satisfactory operation, however, it is convenient for manufacture. The individual needles 13 are fastened to the block 140 by dedicated clamps such as screw-pins 145 that fix individual gauge elements 10 within the block 140. Screw pins 145 enter the block 140 at the rear surface 45 of the block 140 on its lower portion 150. When the block is attached to the gauge bar 27 the screw-pins 145 remain accessible so that individual gauge elements 10 can be removed and replaced.

Figure 8:
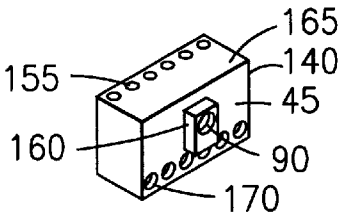
FIG. 8 is a rear perspective view of a modular block of FIG. 6.

FIG. 8 illustrates the top 165 and rear surface 45 of the block 140. Gauge element openings 155 can be seen on the top surface 165 of the block 140. A rectangular tab 160 for positioning the block 140 on the gauge bar 27 is located centrally on the rear surface 45 of the block 140. The rectangular tab 160 defines the opening 90 which aligns with the holes 100 in vertical recesses 40 and with securing screw 65 fixes the block 140 to the gauge bar 27. Openings 170 for screw pins 145 are located horizontally along the lower portion 150 of block 140.

Figure 9:
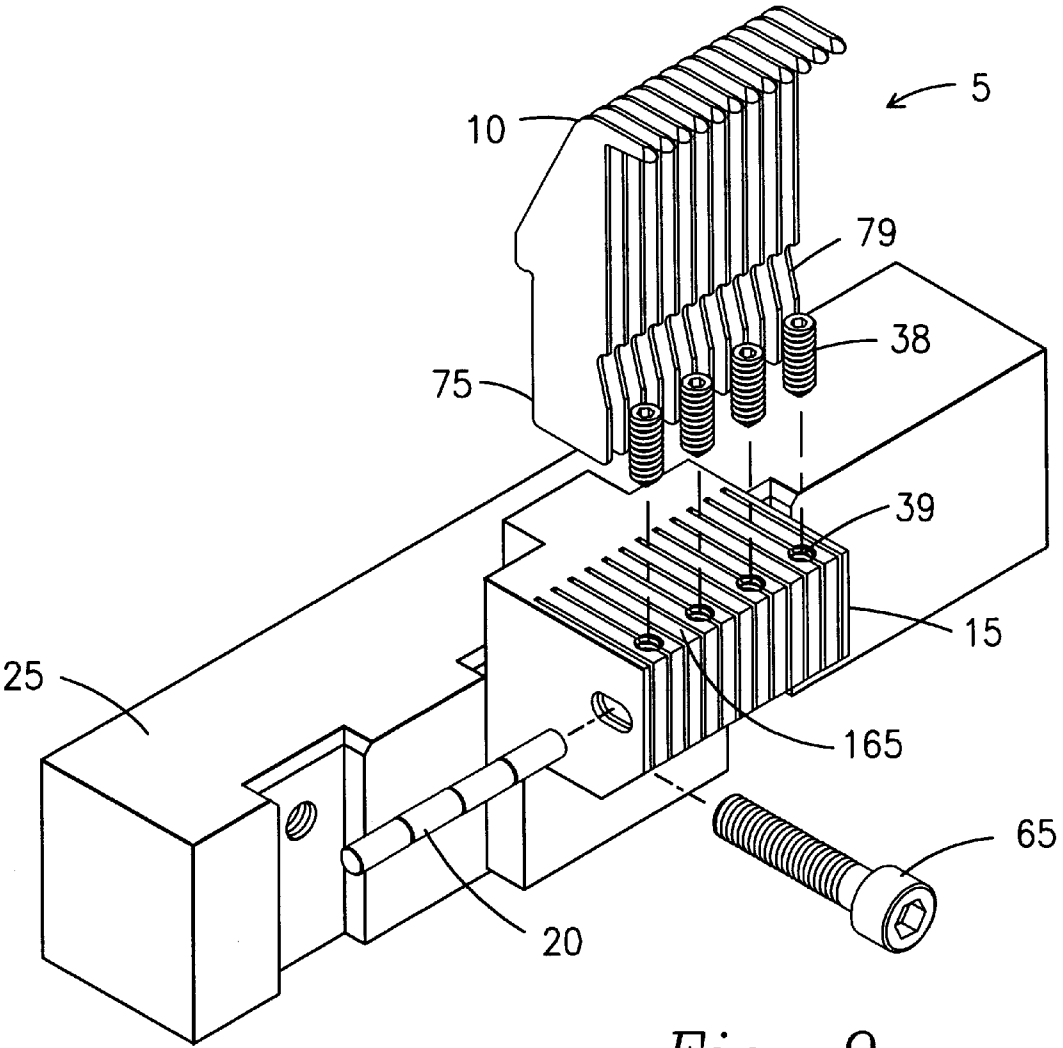
FIG. 9 is an exploded perspective view of a modular assembly having a single row of loop-pile hooks held in place by a lateral pin and securing bolts.

Referring now to FIG. 9, a preferred embodiment of the present invention depicts a modular block assembly 5 having a single row of gauge elements, in this case loop pile hooks 10, housed in a single gauge modular block 15. The modular block 15 may be mounted and attached to the gauge bar 25 with securing screw 65 extending through the block 15 into the gauge bar 25. The gauge elements 10 are inserted in and removably secured to the block 15 by use of lateral pin 20. The lateral pin 20 may be divided into two or more sections, or be formed of somewhat malleable material, to compensate for various differences in the heights of the gauging elements 10.

Unlike the previous embodiments, the illustrated lateral pin 20 does not extend through openings in the gauge elements 10, but merely abuts proximal ends of gauge elements 10 so that the gauge elements 10 are resting on the lateral pin 20. The lateral pin 20 is then biased against the gauging elements 10 by a clamp such as securing bolt 38 received in threaded opening 39 on the top surface 165 of modular block 15. Tightening securing bolts 38 biases the lateral pin 20 against the gauging elements 10. In a preferred embodiment the lateral pin 20 is made of a soft metal such as brass so that when urged by the securing bolt 38, the lateral pin 20 deforms slightly and compresses within channels 79 of individual gauge elements 10. As a result of the clamp, the lateral pin 20 is held in place preventing lateral movement of the pin 20 into or out of the block 15.

Due to differences in the width of the proximal ends 75 and channels 79 of the various gauge elements 10, varying amounts of pressure are required along the length of pin 20 to sufficiently compress and restrain the gauge elements in a fixed position. Thus a preferred construction divides the pin 20 into segments to prevent the necessity of compressing a single pin 20 into all the gauge elements 10.

Figure 10A:
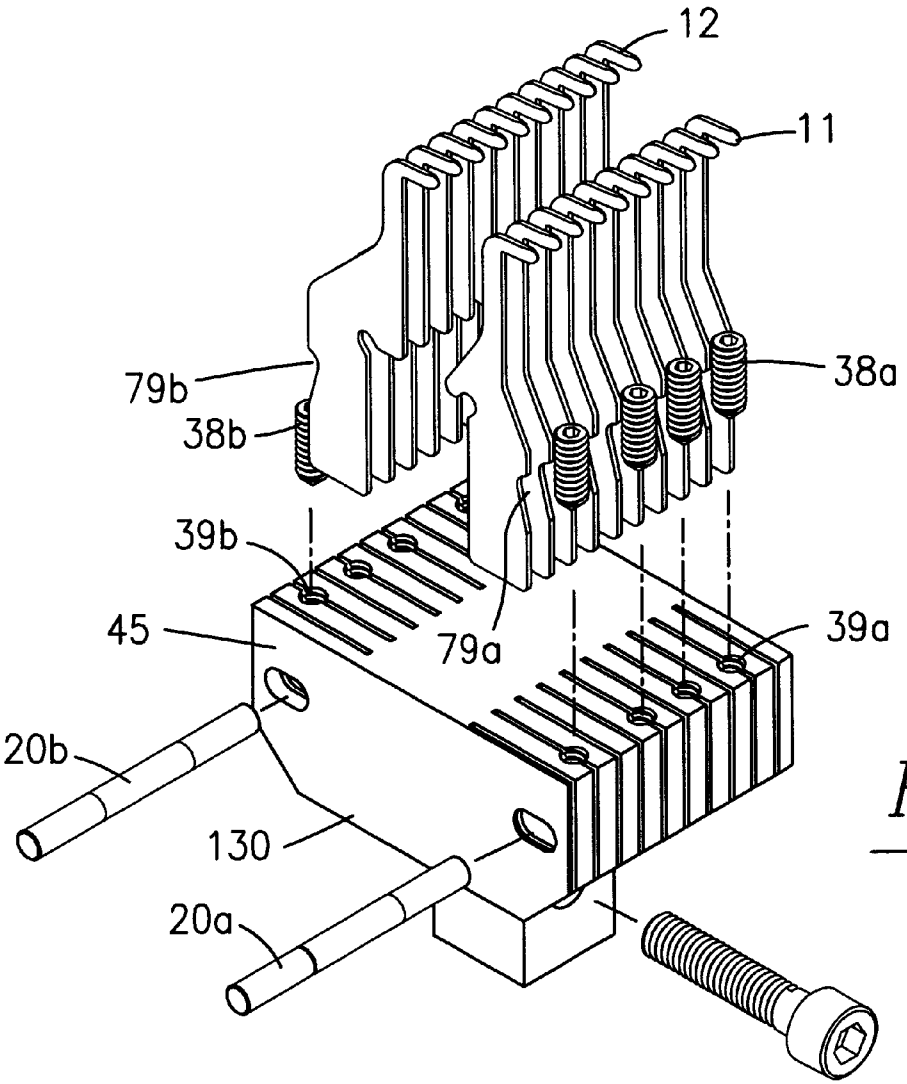
FIG. 10A is an exploded view of a modular block having a double row of loop-pile hooks held in place by lateral pins and securing bolts.

This method of securing gauging elements to a block may also be employed for double gauge modular blocks 130 as seen in FIG. 10A. Rear and forward gauging elements 11 and 12 are arranged in parallel transverse rows on block 130. The rear row of gauging elements 11 is held in position by rear lateral pin 20*a*. Pin 20*a* is biased against the rear gauging elements 11 by securing bolts 38*a* which are received by threaded openings 39*a*. Likewise, the forward gauging elements 12 are held in place by forward lateral pin 20*b* biased against the forward gauging elements 12 by securing bolts 38*b* which are received by threaded openings 39*b*.

Figure 10C:
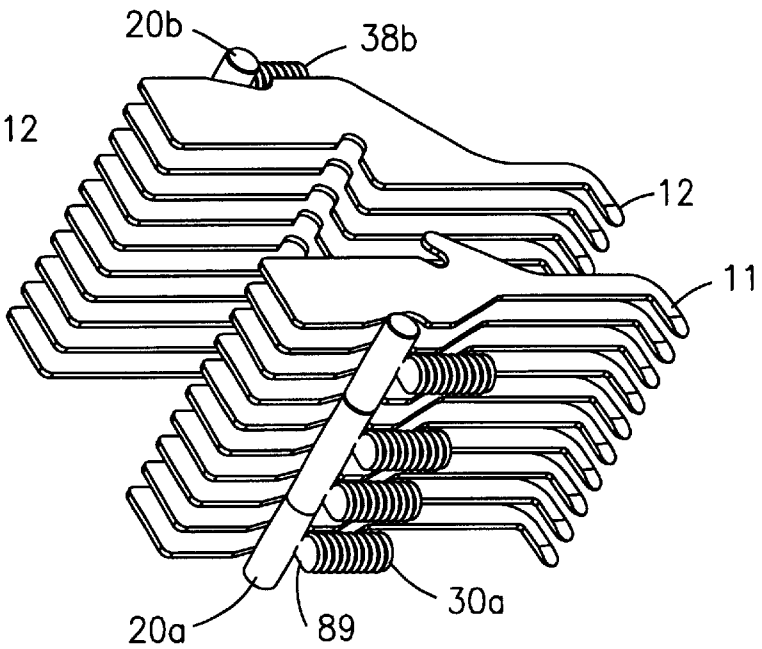
FIG. 10C is a bottom perspective view of the relative positions of the gauge elements, lateral pins and securing bolts of FIG. 10A when mounted in the block.
Figure 10B:
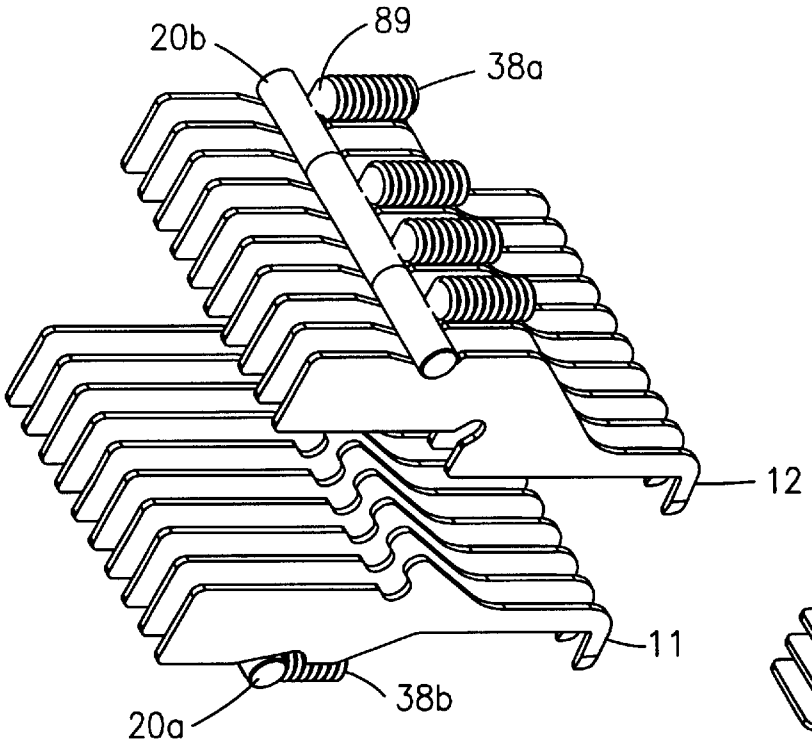
FIG. 10B is a top perspective view of the relative positions of the gauge elements, lateral pins and securing bolts of FIG. 10A when mounted in the block.

In FIGS. 10B and 10C, the gauge elements 11, 12 are shown with lateral pins 20*a*, 20*b* and securing bolts as they would be positioned in blocks 130, however, the blocks are not shown. Of particular interest is the conical point 89 of securing bolts 38*a*, 38*b*. The conical points 89 are aligned alightly off center of lateral pins 20*a*, 20*b*, so that the side wall rather than the vertice of the conical point makes contact with the pins 20*a*, 20*b*. This causes a wedge like or camming effect to pressure pins 20*a*, 20*b* against gauge elements 11, 12. When securing bolts 38*a*, 38*b* utilize camming action rather than mere frontal clamping pressure as would typically be the case if the bolts had flat ends, the bolts 38*a*, 38*b* will continue to function even when wear and operating stresses have introduced some play between the threads of the bolts 38*a*, 38*b* and their openings 38*a*, 39*b*.

Figure 10D:
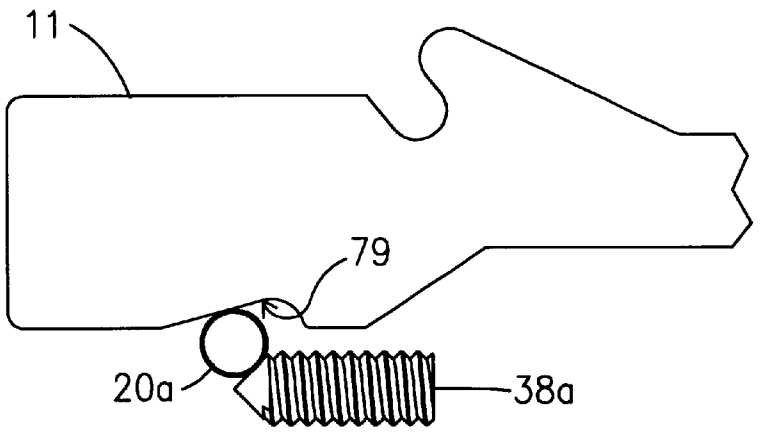
FIG. 10D shows in isolation a side elevation view of the relative positions of a single gauge element, lateral pin and securing bolt when mounted in the block.

FIG. 10D shows a single securing bolt 38*a* with conical point 89 applying camming type pressure against lateral pin 20*a* which is engaged in channel 79 of rear gauge element 11. The modular block 130 that would hold these components is not shown so that the interaction of the gauge element, lateral pin 20*a* and securing bolt 38*a* can be clearly illustrated.

Figure 11A:
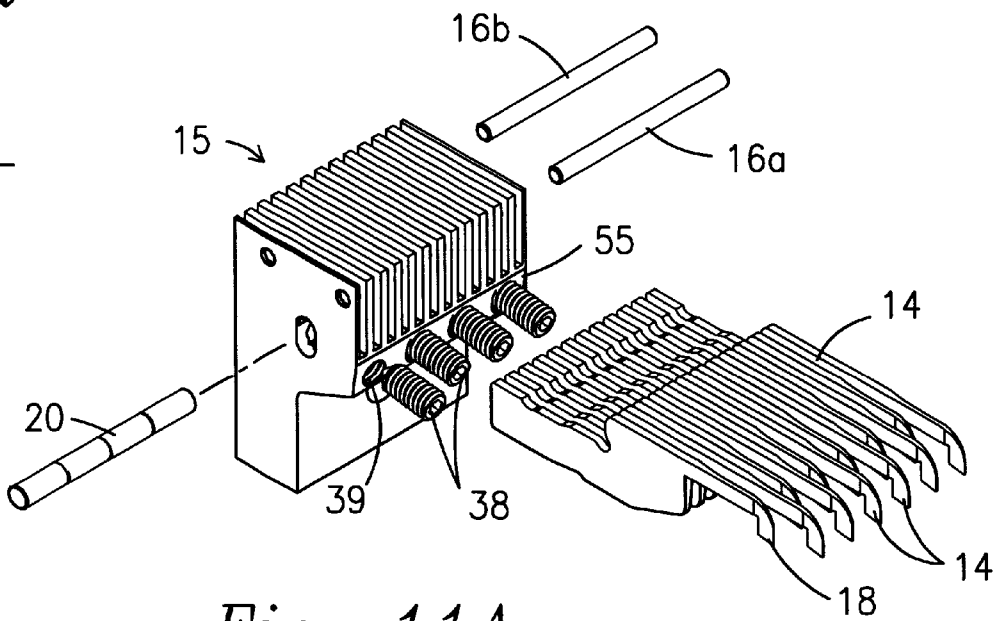
FIG. 11A is an exploded view of a modular block having cut-pile hooks with lateral pins, and securing bolts.

An additional embodiment of the invention is illustrated in FIG. 11A. The gauge elements, in this case cut-pile loopers 14, 18 are shown removed from block 15. When mounted in block 15, the gauge elements 14, 18 fit between lateral bracing pins 16*a*, 16*b* and secured lateral pin 20. The bracing pins 16*a*, 16*b*, are slidably press fit within the block 15 and then gauge elements 14, 18 are positioned. Bracing pins 16a, 16*b* preferably fit in channels 79*a*, 79*b* (shown in FIG. 11C) of gauge elements 14, 18. Pin 20 is also biased against the gauge elements 14, 18 by a clamping device such as securing bolts 38 proceeding through threaded openings 39 to engage the pin 20. Once the gauge elements 14, 18 are placed in the block 15 and the bracing pins 16*a*, 16*b* are positioned in channels 79*a*, 79*b* of those gauge elements 14, 18 and lateral pin 20 is in place in block 15, the securing bolts 38 are tightened to bias the securing pin 20 against the gauge elements 14, 18.

FIG. 11A shows a series of four securing bolts 38. In a preferred embodiment, each securing bolt 38 contacts a dedicated segment of the pin 20. Pin 20 may be made of a malleable metal such as brass and either cut or scored to create segments. Thus, pin 20 may be comprised of four separate pieces. The bolts 38 are sufficiently spaced across the block 15 so that each securing bolt 38 can contact a segment of the securing pin 20 and thereby bias between about two and about four individual gauge elements 14, 18.

Figure 11B:
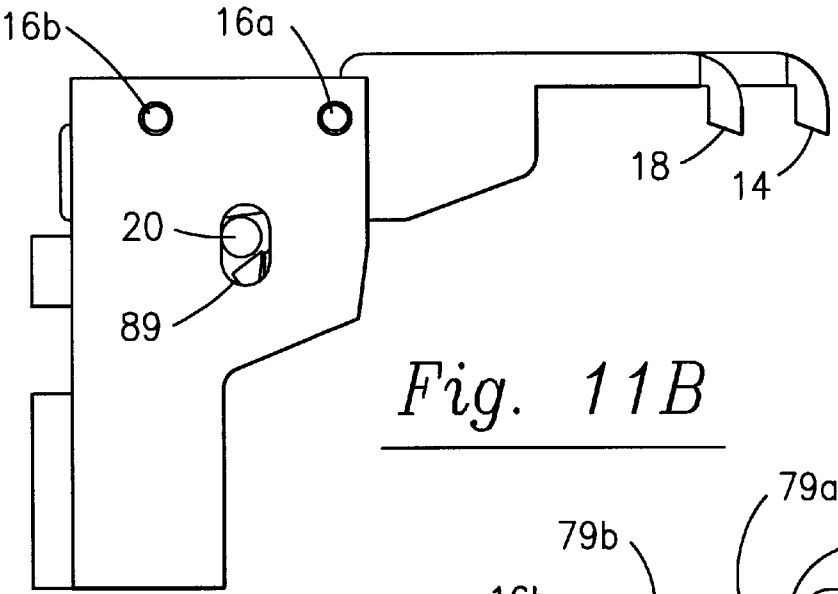
FIG. 11B is a side elevation view of the block of FIG. 11A.
Figure 11C:
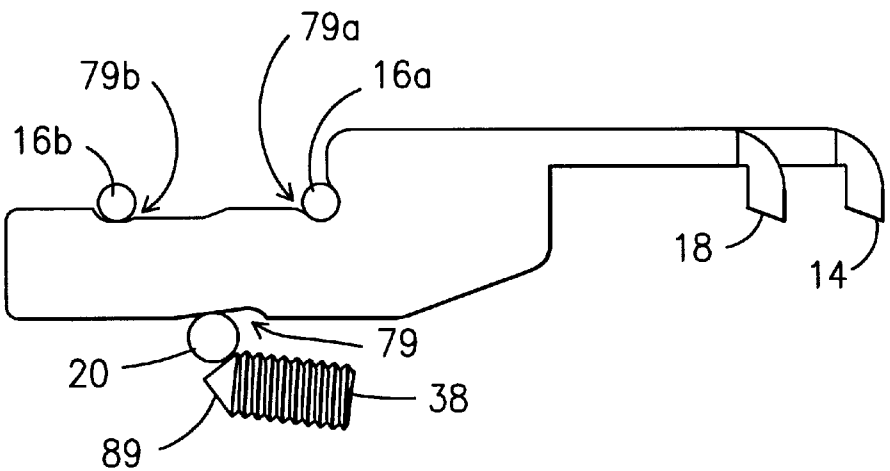
FIG. 11C is a side elevation view of the relative positions of the gauge elements, lateral pins and securing bolt of FIG. 11B when mounted in the block.

FIGS. 11B and 11C are side plan views of the modular block 15 and cut pile loopers 14, 18 of FIG. 11A, however, FIG. 11C shows the gauge elements 14, 18, lateral pins 16*a*, 16*b*, 20, and securing bolts 38 without the modular block 15. It can be seen that cut pile loopers 14, 18 are designed to engage with rear and front rows of needles respectively, although a single length of looper could be used if only one row of needles was to be used to create cut pile tufts. As best seen in FIG. 11B, the side wall of conical point 89 exerts camming pressure against lateral pin 20. Lateral pin 20 in turn engages with the proximal ends of gauge elements 14, 18. FIG. 11C shows that lateral pins 16*a*, 16*b* and 20 are advantageously set in channels 79*a*, 79*b*, 79 formed in the proximal ends of the gauge elements 14, 18.

Although a preferred embodiment of the present invention has been disclosed in detail herein, it will be understood that various substitutions and modifications may be made to the disclosed embodiment described herein without departing from the scope and spirit of the present invention as recited in the appended claims.

What is claimed is:

1. A modular gauge assembly having a plurality of modular blocks carrying removable gauge elements, said blocks being mountable in a plurality of spaced recesses of a tufting machine gauge bar, wherein:

(a) the modular blocks comprise:

(i) a front surface, a pair of side surfaces opposed to each other, a rear surface opposite to the front surface, a top surface and a bottom surface;

(ii) a detent extending from a surface of the modular block to interfit with a spaced recess in the gauge bar;

(iii) a plurality of vertical parallel slots transversely spaced between the opposing side surfaces for receiving gauge elements;

(iv) (iv) a pin opening extending transversely between the opposing side surfaces; and (v) (v) a bolt passage in communication with the pin opening;

(b) the gauge elements have proximal ends received in the parallel slots of the modular block;

(c) a lateral pin extends transversely and substantially through the pin opening of the modular block; and (d) a securing bolt having a leading end extends through the bolt passage and biases the lateral pin against the proximal end of a gauge element;

wherein the modular block comprises a second pin opening extending transversely between opposing side surfaces; a bracing pin extends transversely and substantially through said second pin opening; and the proximal ends of the gauge elements received within the parallel slots of the modular block are interposed between the bracing pin and the lateral pin.

2. A modular gauge assembly having a plurality of modular blocks carrying removable gauge elements, said blocks being mountable in a plurality of spaced recesses of a tufting machine gauge bar, wherein:

(a) the modular blocks comprise:

(i) a front surface, a pair of side surfaces opposed to each other, a rear surface opposite to the front surface, a top surface and a bottom surface;

(ii) a detent extending from a surface of the modular block to interfit with a spaced recess in the gauge bar;

(iii) a plurality of vertical parallel slots transversely spaced between the opposing side surfaces for receiving gauge elements;

(iv) a pin opening extending transversely between the opposing side surfaces; and (v) a bolt passage in communication with the pin opening;

(b) the gauge elements have proximal ends received in the parallel slots of the modular block;

(c) a lateral pin extends transversely and substantially through the pin opening of the modular block; and (d) a securing bolt having a leading end extends through the bolt passage and biases the lateral pin against the proximal end of a gauge element;

wherein the proximal ends of the gauge elements have a channel to receive a lateral pin.

3. A modular gauge assembly having a plurality of modular blocks carrying removable gauge elements, said blocks being mountable in a plurality of spaced recesses of a tufting machine gauge bar, wherein:

(a) the modular blocks comprise:

(i) a front surface, a pair of side surfaces opposed to each other, a rear surface opposite to the front surface, a top surface and a bottom surface;

(ii) a detent extending from a surface of the modular block to interfit with a spaced recess in the gauge bar;

(iii) a plurality of vertical parallel slots transversely spaced between the opposing side surfaces for receiving gauge elements;

(iv) a pin opening extending transversely between the opposing side surfaces; and (v) a bolt passage in communication with the pin opening;

(b) the gauge elements have proximal ends received in the parallel slot of the modular block;

(c) a lateral pin extends transversely and substantially through the pin opening of the modular block; and (d) a securing bolt having a leading end extends through the bolt passage and biases the lateral pin against the proximal end of a gauge element;

wherein the detent extends approximately from the center of the bottom surface of the block.

4. A modular gauge assembly having a plurality of modular blocks carrying removable gauge elements, said blocks being mountable in a plurality of spaced recesses of a tufting machine gauge bar, wherein:

(a) the modular blocks comprise:

(i) front surface, a pair of side surfaces opposed to each other, a rear surface opposite to the front surface, a top surface and a bottom surface;

(ii) a detent extending from a surface of the modular block to interfit with a spaced recess in the gauge bar;

(iii) a plurality of vertical parallel slots transversely spaced between the opposing side surfaces for receiving gauge elements;

(iv) a pin opening extending transversely between the opposing side surfaces; and (v) a bolt passage in communication with the pin opening;

(b) the gauge elements have proximal ends received in the parallel slots of the modular block;

(c) a lateral pin extends transversely and substantially through the pin opening of the modular block; and (d) a securing bolt having a leading end extends through the bolt passage and biases the lateral pin against the proximal end of a gauge element;

wherein the modular block has a second plurality of parallel vertical slots transversely spaced between the opposing side surfaces for receiving proximal ends of gauge elements and a second lateral pin extends through a second pin opening between the opposing side surfaces of the modular block and is adjacent to the proximal ends of gauge elements received within the second plurality of vertical slots.

5. A modular block assembly for use in a tufting machine comprising:

(a) a modular block having a front surface, a pair of opposed side surfaces, a rear surface, a top surface and a bottom surface; and a plurality of vertical parallel slots separated by vertical walls and transversely spaced between the opposing side surfaces; and a pin opening extending transversely between the opposing side surfaces;

(b) a plurality of gauge elements having a distal end and a proximal end, the proximal ends of said gauge elements being received in the vertical parallel slots of the modular block;

(c) a lateral pin extending transversely through the pin opening of the modular blocks; and (d) a first securing bolt having a leading end in contact with the lateral pin;

wherein the modular block comprises a second pin opening extending transversely between the opposing side surfaces; a bracing pin extends transversely and substantially through said second pin opening; and the proximal ends of gauge elements received within the parallel slots are interposed between the bracing pin and the lateral pin.

6. A modular gauge assembly having a plurality of modular blocks carrying removable gauge elements, said blocks being mountable in a plurality of spaced recesses of a tufting machine gauge bar, wherein:

(a) the gauge elements are selected from the group consisting of needles, loopers and hooks;

(b) the modular blocks comprise:

(i) a front surface, a pair of side surfaces opposed to each other, a rear surface opposite to the front surface, a top surface and a bottom surface;

(ii) a detent extending from a surface of the modular block to interfit with a spaced recess in the gauge bar;

(iii) a plurality of vertical parallel slots transversely spaced between the opposing side surfaces for receiving gauge elements;

(iv) a pin opening extending transversely between the opposing side surfaces; and (v) a bolt passage in communication with the pin opening.

(c) the gauge elements have proximal ends received in the parallel slots of the modular block;

(d) a lateral pin extends transversely and substantially through the pin opening of the modular block; and (e) a securing bolt having a leading end extends through the bolt passage and biases the lateral pin against the proximal end of a gauge element.

7. The modular gauge assembly of claim 6 wherein: the modular block comprises a second pin opening extending transversely between opposing side surfaces; a bracing pin extends transversely and substantially through said second pin opening; and the proximal ends of the gauge elements received within the parallel slots of the modular block are interposed between the bracing pin and the lateral pin.

8. The modular gauge assembly of claim 6 wherein the proximal ends of the gauge elements have a channel to receive a lateral pin.

9. The modular gauge assembly of claim 6 wherein the bolt passage is a threaded opening for receiving a threaded securing bolt.

10. The modular gauge assembly of claim 6 wherein the detent extends from the rear surface of the block.

11. The modular gauge assembly of claim 6 wherein the detent extends approximately from the center of the bottom surface of the block.

12. The modular gauge assembly of claim 6 wherein the lateral pin has at least two segments.

13. The modular gauge assembly of claim 6 wherein the lateral pin comprises a malleable metal.

14. The modular gauge assembly of claim 6 wherein the leading end of the securing bolt is conical and exerts a camming force on the lateral pin.

15. The modular gauge assembly of claim 6 wherein the modular block has a second plurality of parallel vertical slots transversely spaced between the opposing side surfaces for receiving proximal ends of gauge elements.

16. The modular gauge assembly of claim 15 a second lateral pin extends through a second pin opening between the opposing side surfaces of the modular block and is adjacent to the proximal ends of gauge elements received within the second plurality of vertical slots.

17. The modular gauge assembly of claim 6 wherein a fastener secures the modular block to the gauge bar.

18. The modular gauge assembly of claim 6 wherein the gauge element are disposed in a plane normal to the length of the lateral pin.

19. The modular gauge assembly of claim 6 wherein the securing bolt is positioned in a plain normal to the length of the lateral pin.

20. A modular block assembly for use in a tufting machine comprising:

(a) a modular block having a front surface, a pair of opposed side surfaces, a rear surface, a top surface and a bottom surface; and a plurality of vertical parallel slots separated by vertical walls and transversely spaced between the opposing side surfaces; and a pin opening extending transversely between the opposing side surfaces;

(b) a plurality of gauge elements selected from the group consisting of needles, loopers and hooks, having a distal end and a proximal end, the proximal ends of said gauge elements being received in the vertical parallel slots of the modular block;

(c) a lateral pin extending transversely through the pin opening of the modular blocks; and (d) a first securing bolt having a leading end in contact with the lateral pin.

21. The modular block assembly of claim 20 wherein the leading end of the securing bolt is conical, having side walls coming to a vertice, and a side wall of the leading end is in contact with the lateral pin.

22. The modular block assembly of claim 20 wherein the lateral pin has a plurality of segments and a second securing bolt has a leading end in contact with a segment other than the segment contacted by the first securing bolt.

23. The modular block assembly of claim 22 wherein a lateral pin segment a plurality of gauge elements.

24. The modular block assembly of claim 20 wherein the lateral pin is slightly deformable when biased by the leading end of the first securing bolt.

25. The modular block assembly of claim 20 wherein: the modular block comprises a second pin opening extending transversely between the opposing side surfaces; a bracing pin extends transversely and substantially through said second pin opening; and the proximal ends of gauge elements received within the parallel slots are interposed between the bracing pin and the lateral pin.

* * * * *